US006099664A

United States Patent [19]

Davies et al.

[11] Patent Number: 6,099,664

[45] **Date of Patent: *Aug. 8, 2000**

[54] METAL MATRIX ALLOYS

[75] Inventors: Peter Davies, Herringthorpe; James Leslie Frederick Kellie, Bamford; Richard Nigel Mc Kay, Wadsley; John Vivian Wood, Bolnhurst, all of United Kingdom

[73] Assignee: London & Scandinavian Metallurgical Co., Ltd., United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/980,403

[22] Filed: Nov. 28, 1997

Related U.S. Application Data

[63] Continuation of application No. 08/783,824, Jan. 13, 1997, which is a continuation of application No. 08/487,162, Jun. 7, 1995, which is a continuation of application No. 08/186,151, Jan. 25, 1994.

[30] Foreign Application Priority Data

Jan. 26, 1993 [GB] United Kingdom ..... 9301458

[51] Int. Cl.[7] ..... B22F 3/23

[52] U.S. Cl. ..... 148/513; 148/515; 164/97; 419/12

[58] Field of Search ..... 420/129, 590; 148/513, 514, 515; 419/12; 164/97

[56] References Cited

U.S. PATENT DOCUMENTS

| | | | |
|---|---|---|---|
| 3,726,643 | 4/1973 | Merzhanov et al. . | |
| 4,431,448 | 2/1984 | Merzhanov et al. . | |
| 4,673,550 | 6/1987 | Dallaire | 419/12 |
| 4,710,348 | 12/1987 | Brupbacher et al. | 420/590 |
| 4,777,014 | 10/1988 | Newkirk et al. | 164/97 |
| 4,836,982 | 6/1989 | Brupbacher et al. | 420/129 |
| 4,915,903 | 4/1990 | Brupbacher et al. | 420/129 |
| 5,015,534 | 5/1991 | Kampe et al. | 428/570 |
| 5,301,739 | 4/1994 | Cook | 164/97 |
| 5,708,956 | 1/1998 | Dunmead et al. | 419/12 |

FOREIGN PATENT DOCUMENTS

| | | |
|---|---|---|
| 0360438 | of 1990 | European Pat. Off. . |
| 0808270 | of 1959 | United Kingdom . |
| 1431145 | of 1976 | United Kingdom . |
| 1431882 | of 1976 | United Kingdom . |
| 1452165 | of 1976 | United Kingdom . |
| 2257985 | of 1993 | United Kingdom . |
| 2259309 | of 1993 | United Kingdom . |
| 8803574 | of 1988 | WIPO . |
| 8807593 | of 1988 | WIPO . |

OTHER PUBLICATIONS

Volume A1, Ullmann's Encyclopedia of Industrial Chemistry, pp. 447–457 (5th ed. 1985).

*Primary Examiner*—George Wyszomierski
*Attorney, Agent, or Firm*—Fish & Neave; Jeffrey H. Ingerman; Eric H. Huang

[57] ABSTRACT

The invention provides a method of making a titanium boride metal matrix alloy, by firing a particulate reaction mixture comprising titanium, matrix material and a source of boron (e.g. boron carbide), under conditions such that the titanium and boron react exothermically to form a dispersion of fine particles (preferably greater than 1 micron and less than 10 microns in size) comprising titanium boride (plus titanium carbide where the source of boron is boron carbide) in a predominantly metal matrix. The titanium and matrix are preferably added as a titanium alloy such as ferrotitanium (e.g. eutectic ferrotitanium) or titanium-aluminium. The reaction conditions are preferably selected so that during the reaction a molten zone moves through the body of the reaction mixture, and the average size of the resulting hard particles is uniform throughout the resulting dispersion.

20 Claims, 1 Drawing Sheet

METAL MATRIX ALLOYS

This application is a continuation of application Ser. No. 08/783,824, filed Jan. 13, 1997, now abandoned which is a continuation of Ser. No. 08/487,162 filed Jun. 7, 1995, which is a continuation of Ser. No. 08/186,151 filed Jan. 25, 1994.

This invention relates to a method of making an alloy comprising hard particles comprising titanium boride dispersed in a predominantly metal matrix, and to the resulting alloy itself. Alloys of the aforementioned kind are hereinafter referred to as titanium boride metal matrix alloys.

Our U. K. patent application no. 9116174.5, which was filed on Jul. 26, 1991, and which was published on Jan. 27, 1993 as GB 2257985 A, describes and claims a method of making an alloy comprising hard particles comprising titanium carbide dispersed in a predominantly metal matrix, the method comprising firing a particulate reaction mixture comprising carbon, titanium and matrix material, under conditions such that the titanium and carbon react exothermically to form a dispersion of fine particles comprising titanium carbide in a predominantly metal matrix.

According to the present invention, there is provided a method of making an alloy comprising hard particles comprising titanium boride dispersed in a predominantly metal matrix, the method comprising firing a particulate reaction mixture comprising titanium, matrix material and a source of boron, under conditions such that the titanium and boron react exothermically to form a dispersion of fine particles comprising titanium boride in a predominantly metal matrix.

It is surprising that the exothermic reaction of the method of the invention is capable of producing a dispersion of fine, hard particles in the matrix. However, we have found that it is possible, using simple trial and error experiments, to find suitable conditions to achieve that end, when the following principles are borne in mind:

(i) It is highly desirable to adjust the reaction conditions such that the exothermic reaction is carried out under conditions such that during the reaction a molten zone moves through the body of the reaction mixture, so that at a given point during reaction the reaction mixture ahead of the reaction zone is solid, and so is that behind the reaction zone.

(ii) The hard particles may be of generally globular shape. That would indicate that the reaction zone had reached a sufficiently high temperature to allow precipitation of the hard particles. However, in many preferred embodiments of the invention, at least some of the hard particles may be of angular shape, and indeed in many cases they are all thus shaped.

(ii) In order to promote uniformity of reaction conditions, and thus also uniformity of the physical properties of the product, the bulk of the reaction mixture should not be too small (unlikely to occur in practice) or too large. Success in this regard can readily be assessed by observing the uniformity of the particle size of the hard particles formed throughout the reaction mixture. Preferably, the average particle size of the hard particles is substantially uniform throughout the resulting dispersion.

(iv) The longer the hard particles are present in a melt before solidification, the larger their final size will be. If the hard particles are found to be undesirably large through being present in a melt for too long a time, the process conditions can be adjusted so that the temperature reached in the reaction is decreased and/or the cooling rate is increased.

(v) The temperature reached in the exothermic reaction can be decreased by one or more of the following measures:

(a) decreasing the concentration of the reactants, e.g. by increasing the concentration of matrix material;

(b) increasing the particle size of the reactants; and (c) decreasing the weight of the reaction mixture.

(d) replacing a part of the titanium reactant by an additional carbide-forming reactant which reacts with the carbon less exothermically than does the titanium reactant.

The temperature can, of course, be increased by reversing one or more of (a), (b), (c) and (d).

Generally, the titanium boride present in the product of the method of the invention will be in the form of titanium diboride.

It will be appreciated that in the method of the invention, the particulate reaction mixture which is fired may include reactable materials in addition to the source of boron and the titanium, which additional reactable materials may be present in the matrix material or otherwise; for example chromium, tungsten, vanadium, niobium, carbon and/or nitrogen. The resulting fine particles comprising titanium boride will therefore not necessarily consist of titanium boride as such.

Desirably, the available titanium content of the reaction mixture is equal to at least 30% by weight, and preferably greater than 50% and less than 70% by weight, of the total weight of the reaction mixture (the term "reaction mixture" as used herein means the total of all the materials present in the reaction body, including any which do not undergo any chemical reaction in the method of the invention and which may in effect be a diluent). This will generally enable sufficient heat to be generated in the exothermic reaction, and a useful concentration of hard particles to be formed in the product.

The source of boron in the reaction mixture may be boron itself, in the form of boron powder, for example. However, we prefer that the source of boron should comprise a suitable compound of boron, preferably boron carbide, $B_4C$.

The matrix metal may be based on iron or aluminium, for example. It may be possible for the matrix metal to be based on other metals such as nickel, cobalt or copper, for example. We prefer that substantially all of the titanium should be present in the reaction mixture as an alloy of matrix metal and titanium. However, some or, in less preferred embodiments all, of the matrix metal may be present in the reaction mixture unalloyed with titanium. Where the product alloy is to be iron-based, we prefer that the titanium should be present in the reaction mixture as ferrotitanium, and most preferably as eutectic ferrotitanium, which contains about 70% by weight titanium. In the latter case, we have found that a suitable particle size for the eutectic ferrotitanium is generally in the range 0.5 mm down to 3.0 mm down.

Where the product alloy is to be aluminium-based, we prefer that the titanium should be present in the reaction mixture as titanium-aluminium, wherein the titanium content is preferably about 60% by weight, and the particle size is preferably about 300 microns down.

In some instances, for example where the concentration of titanium in the reaction mixture is particularly low, the reaction mixture may need to be pre-heated in order to get it to fire and react without further heat input. However, we prefer that the temperature of the body of the reaction mixture should be at less than 600° C., and preferably at less than 500° C., immediately prior to firing.

We most prefer that the temperature of the body of the particulate reaction mixture is substantially at ambient temperature (i.e. at no more than 100° C.) immediately prior to firing. Where a particular reaction mixture will not fire at ambient temperature, it may be modified, using the principles described above, so that it can be fired at ambient temperature and react without requiring further heat input.

Preferably the particulate reaction mixture which is fired is a loose mixture (i.e. a mixture which, although it may have been packed, has not been compressed to such an extent as to cause it to become fully cohesive, as occurs in briquetting). We have found that briquetting of the reaction mixture very much reduces its ability to be fired so as to produce a self-sustaining reaction. For the same reason, the reaction mixture, if packed at all, is preferably not compressed sufficiently to produce any substantial degree of cohesion.

The firing of the particulate reaction mixture in the method according to the invention may be performed in any suitable manner. For example, an ignitable firing material (e.g. titanium particles) may be positioned at the surface of the particulate reaction mixture and sufficient heat applied to the ignitable material to cause ignition. Alternatively, the particulate reaction mixture may be fired by heating in such a way that an outer skin of the particulate reaction mixture is heated to a high temperature, sufficient to initiate the exothermic reaction, the body of the particulate reaction mixture having undergone relatively little heating at that stage; this can be achieved by, for example, heating the particulate reaction mixture in a heat-inducing (e.g. clay graphite or silicon carbide) crucible, in a coreless induction furnace.

For most end uses of the product, we prefer that the amount of the source of boron in the reaction mixture should be substantially the stoichiometric amount required to react with all of the available titanium in the reaction mixture. In particular, in the preferred embodiment where the source of boron is boron carbide, we prefer that the amount of $B_4C$ is such that the total amount of boron and carbon in it is stoichiometrically equivalent to the available titanium.

We have found that by practising the invention taking into account the points discussed above, it is easily possible to arrange that the average particle size of the hard particles in the product is less than 25 microns, and an average particle size of less than 10 microns can be achieved without difficulty; generally the average particle size will be greater than 1 micron.

In accordance with a preferred embodiment, the method of the invention comprises firing a reaction mixture comprising boron carbide and crushed eutectic ferrotitanium under conditions such that a molten zone moves through the body of the reaction mixture, to form a dispersion of a mixture of titanium diboride particles and titanium carbide particles of average particle size greater than 1 micron and less than 10 microns in a ferrous metal matrix.

For many end uses it is desirable to reduce the dispersion produced by the method of the invention to a powder; one having an average particle size of less than 250 microns is preferred.

BRIEF DESCRIPTION OF THE DRAWINGS

In order that the invention may be more fully understood, some preferred embodiments in accordance therewith will now be described in the following Examples, with reference to the accompanying drawings wherein.

DETAILED DESCRIPTION OF PREFERRED EMBODIMENTS

EXAMPLE 1

1 kg of eutectic ferrotitanium (70% titanium, by weight) produced by London & Scandinavian Metallurgical Co Limited were crushed to less than 2 mm. This was then mixed with 267 g of boron carbide ($B_4C$) ground to less than 500 microns, The mixture was loosely packed into a refractory lined vessel. The mixture was ignited by forming a depression in its top surface, which was filled with titanium sponge powder, to which a flame was applied.

Once ignited, an exothermic reaction propagated throughout the whole of the powder bed, such that, at a given point during the reaction the reaction mixture ahead of the reaction zone was solid, the reaction zone itself was liquid and the reacted material behind the reaction zone was solid.

Figure 1:
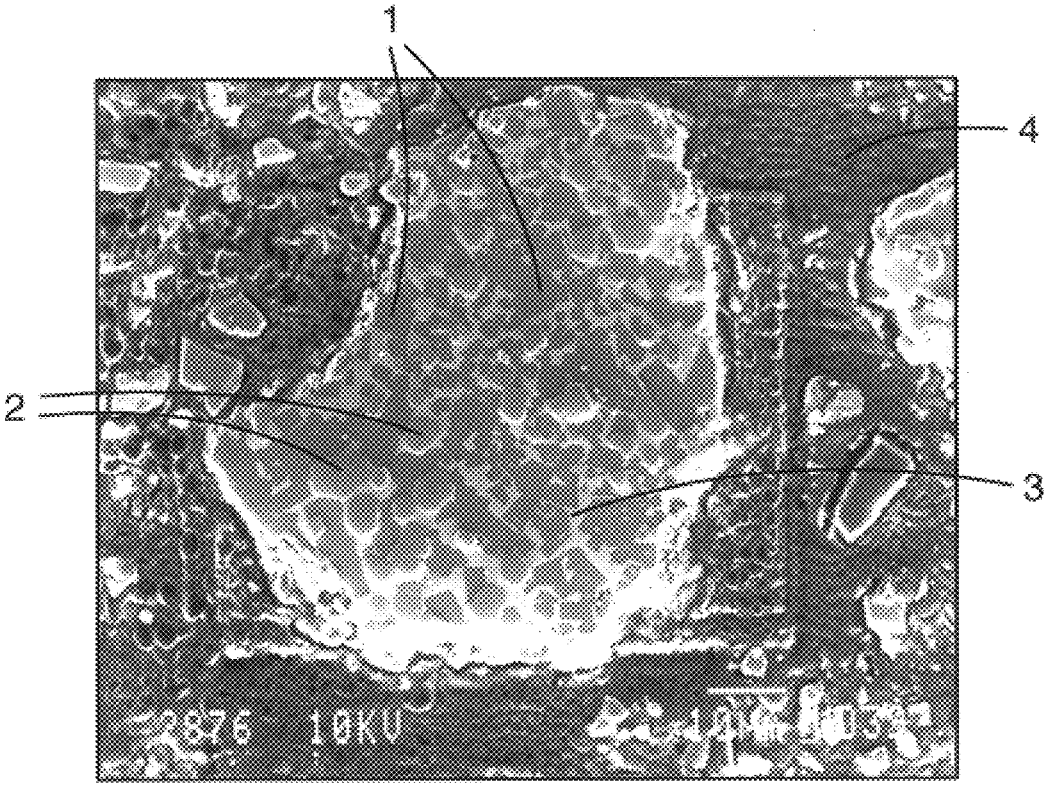
FIG. 1 shows a scanning electron micrograph, at a magnification of 1000, of the alloy produced in Example 1.

After cooling, the product was crushed to a 2 mm down powder. FIG. 1 is a scanning electron micrograph of the product, and shows that it consists of a uniform dispersion of a larger proportion of $TiB_2$ particles (about 53% by weight of the product, as those shown at 1) and a lesser number of TiC particles (about 23% by weight of the product, as those which can be seen relatively raised at 2) in an iron matrix (about 24% by weight of the product, as can be seen at 3). This proportion is consistent with the stoichiometry of the $B_4C$ and FeTi reactants. The mounting resin can be seen at 4.

EXAMPLE 2

1 kg of titanium-aluminium powder (60% titanium by weight) produced by London & Scandinavian Metallurgical Co Limited having a particle size less than 300 microns were mixed with 229 g of boron carbide of less than 500 microns particle size The mixture was loosely packed into a refractory lined vessel and fired as in Example 1.

Once ignited an exothermic reaction propagated throughout the whole of the powder bed, such that, at a given point during the reaction, the reaction mixture ahead of the reaction zone was solid, the reaction zone itself was liquid and the reacted material behind the reaction zone was solid.

Figure 2:
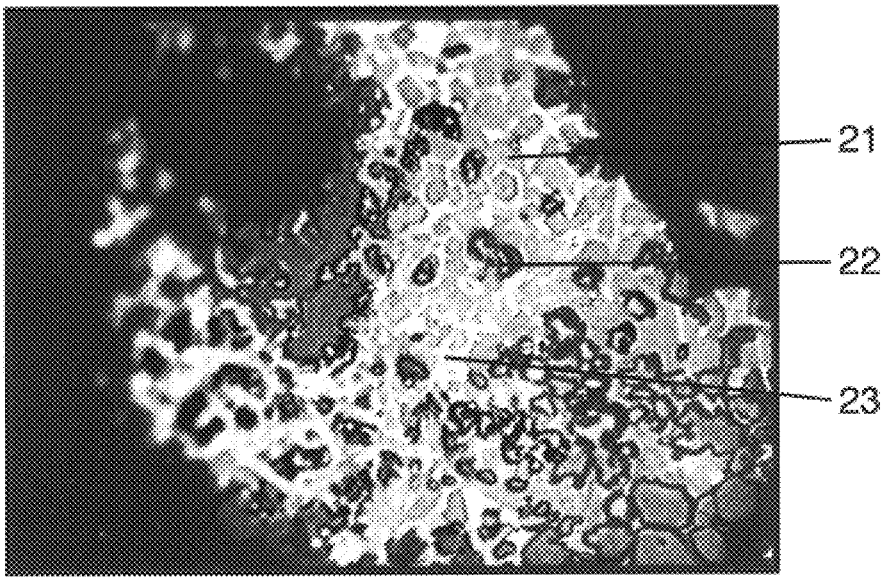
FIG. 2 shows a photomicrograph, at a magnification of 1000, of the alloy produced in Example 2.

After cooling, the product was comminuted. FIG. 2 is a photomicrograph of the product, and shows that it consists of a uniform dispersion of $TiB_2$ particles (as those shown at 21) and TiC particles (as those shown at 22) in an aluminium matrix (as shown at 23).

EXAMPLE 3

300 g of crushed eutectic ferrotitanium as used in Example 1 were mixed with 94.5 g of fine boron powder having a particle size of 45 microns down. The mixture was loosely packed into a refractory lined vessel and fired as in Example 1.

Once ignited, a very vigorous exothermic reaction propagated throughout the whole of the powder bed, such that, at a given point during the reaction the reaction mixture ahead of the reaction zone was solid, the reaction zone itself was liquid and the reacted material behind the reaction zone was solid.

After cooling, the product was comminuted. It consisted of a uniform dispersion -of $TiB_2$ particles in an iron matrix.

What is claimed is:

1. A method of making an alloy comprising hard particles comprising titanium boride dispersed in a predominantly metal matrix, the method comprising firing a body of loose particulate reaction mixture comprising titanium, metal matrix material and a source of boron, said reaction mixture not having been compressed to an extent to produce any substantial degree of cohesion, wherein said firing is accomplished by applying heat to only a portion of the body of loose particulate reaction mixture so as to initiate an exothermic reaction, under conditions such that (I) the titanium and boron react exothermically to form a dispersion of fine particles comprising titanium boride in a predominantly metal matrix;

(ii) the titanium is present in the reaction mixture as an alloy of matrix metal and titanium; and (iii) the body of the loose particulate reaction mixture is at a temperature less than 600° C. immediately prior to performing said firing step.

2. A method according to claim 1, wherein the exothermic reaction is carried out under conditions such that during the reaction a molten zone moves through the body of the reaction mixture.

3. A method according to claim 1, wherein the average particle size of the particles comprising titanium boride is substantially uniform throughout the resulting dispersion.

4. A method according to claim 1, wherein the available titanium content of the reaction mixture is equal to at least 30% by weight of the total weight of the reaction mixture.

5. A method according to claim 1, wherein the source of boron in the reaction mixture comprises a compound of boron.

6. A method according to claim 1, wherein the source of boron in the reaction mixture comprises boron carbide.

7. A method according to claim 1, comprising firing a body of loose particulate reaction mixture comprising boron carbide and eutectic ferrotitanium under conditions such that a molten zone moves through the body of the reaction mixture to form a dispersion of a mixture of titanium diboride particles and titanium carbide particles of average particle size greater than 1 micron and less than 10 microns in a ferrous metal matrix, the particle size of the eutectic ferrotitanium is such as is obtainable by sieving material through a sieve which has a sieve aperture in the range from 0.5 mm to 3.0 mm, and the body of loose particulate reaction mixture is at a temperature less than 500° C. immediately prior to firing.

8. A method according to claim 1, wherein titanium is present in the reaction mixture as ferrotitanium.

9. A method according to claim 8, wherein titanium is present in the reaction mixture as eutectic ferrotitanium.

10. A method according to claim 9 wherein the particle size of the eutectic ferrotitanium is such as is obtainable by sieving material through a sieve which has a sieve aperture in the range from 0.5 mm to 3.0 mm.

11. A method according to claim 1, wherein titanium is present in the reaction mixture as an alloy comprising aluminium and titanium.

12. A method according to claim 11, wherein the alloy comprising aluminium and titanium comprises about 70% by weight of titanium.

13. A method according to claim 1, wherein the body of loose particulate reaction mixture is at a temperature less than 500° C. immediately prior to firing.

14. A method according to claim 13, wherein the body of loose particulate reaction mixture is substantially at ambient temperature immediately prior to firing.

15. A method according to claim 1, wherein the average particle size of the particles comprising titanium boride is less than 25 microns.

16. A method according to claim 15, wherein the average particle size of the particles comprising titanium boride is greater than 1 micron and less than 10 microns.

17. A method according to claim 1, comprising firing a body of loose particulate reaction mixture comprising boron carbide and crushed eutectic ferrotitanium under conditions such that a molten zone moves through the body of the reaction mixture, to form a dispersion of a mixture of titanium diboride particles and titanium carbide particles of average particle size greater than 1 micron and less than 10 microns in a ferrous metal matrix.

18. A method according to claim 1, further comprising reducing the dispersion to a powder.

19. A method according to claim 18, wherein the dispersion is reduced to a powder of average particle size less than 250 microns.

20. A method according to claim 1, wherein the available titanium content of the reaction mixture is greater than 50% and less than 70% by weight of the total weight of the reaction mixture.

* * * * *

UNITED STATES PATENT AND TRADEMARK OFFICE

CERTIFICATE OF CORRECTION

PATENT NO. : 6,099,664
DATED : August 8, 2000
INVENTOR(S) : Peter Davies, et al.

It is certified that error appears in the above-identified patent and that said Letters Patent is hereby corrected as shown below:

Title page,
In the listing of inventors on the title page, change "Richard Nigel Mc Kay" to -- Richard Nigel Mckay --;

Column 1,
Line 4, insert -- , -- after "abandoned";
Line 5, insert -- now abandoned, -- after "Jun. 7, 1995,"
Line 7, change "1994." to -- 1994, now abandoned.-- ;
Line 51, change "(ii)" to -- (iii) --;

Column 2,
Line 3, change "reactants; and " to -- reactants; --
Line 4, change "mixture." to -- mixture; and --

UNITED STATES PATENT AND TRADEMARK OFFICE

CERTIFICATE OF CORRECTION

PATENT NO. : 6,099,664
DATED : August 8, 2000
INVENTOR(S) : Peter Davies, et al.

It is certified that error appears in the above-identified patent and that said Letters Patent is hereby corrected as shown below:

Column 4,
Line 29, change "size" to -- size. --;
Line 56, change "-of" to -- of --;

Column 5,
Line 1, change "(I)" to -- (i) --; and

Column 6,
Line 1, change "9" to -- 9,--.

Signed and Sealed this

Seventh Day of August, 2001

*Attest:*

Nicholas P. Godici

*Attesting Officer*

NICHOLAS P. GODICI
*Acting Director of the United States Patent and Trademark Office*